US005222910A

United States Patent [19]

Boros et al.

[11] Patent Number: 5,222,910

[45] Date of Patent: Jun. 29, 1993

[54] PLUG ELEMENT FOR AN ELECTRICAL CONNECTION, IN PARTICULAR IN DISTRIBUTION BOARDS OR SIMILAR INSTALLATIONS

[75] Inventors: Ferenc Boros, Lohmar; Rainer Haar, Bonn, both of Fed. Rep. of Germany

[73] Assignee: Klockner Moeller GmbH, Bonn, Fed. Rep. of Germany

[21] Appl. No.: 812,618

[22] Filed: Dec. 23, 1991

Related U.S. Application Data

[63] Continuation-in-part of PCT/EP91/00729, Apr. 17, 1991.

[30] Foreign Application Priority Data

Apr. 26, 1990 [DE] Fed. Rep. of Germany ..... 4013311

[51] Int. Cl.[5] ..... H01R 13/00

[52] U.S. Cl. ..... 439/699; 439/825

[58] Field of Search ..... 439/699, 825

[56] References Cited

U.S. PATENT DOCUMENTS

| | | | |
|---|---|---|---|
| 919,394 | 4/1909 | Taylor et al. | 439/699 |
| 2,674,723 | 4/1954 | Hurlburt | 439/699 |
| 4,810,213 | 3/1989 | Chabot | 439/825 |

FOREIGN PATENT DOCUMENTS

| | | |
|---|---|---|
| 0086316 | 8/1983 | European Pat. Off. . |
| 0204475 | 12/1986 | European Pat. Off. . |
| 2647573 | 12/1977 | Fed. Rep. of Germany . |
| 3126306 | 1/1983 | Fed. Rep. of Germany . |
| 3243064 | 5/1984 | Fed. Rep. of Germany . |
| 4013311 | 10/1991 | Fed. Rep. of Germany . |
| 1564514 | 4/1980 | United Kingdom . |
| 2189088 | 10/1987 | United Kingdom . |

OTHER PUBLICATIONS

Sonderdruck aus BBC-Informationsheft "Konstrukteur" 5/69 Sep. 1969, pp. 185-189.

*Primary Examiner*—Joseph H. McGlynn
*Attorney, Agent, or Firm*—Nils H. Ljungman & Associates

[57] ABSTRACT

An apparatus for electrical connection which has good contact characteristics, consists of simple parts, is easy to assemble and install, and is also suitable for the electrical connection to C-shaped bus bars or bus bars with slot shaped tap zones, which bus bars are preferably in withdrawable unit distribution boards or panels. The apparatus preferably has a mounting element, elastic contact elements, and a plug element. The plug element preferably has a plug shell, a contact strip, and contact laminar strips, which contact laminar strips are embedded in window like openings of the plug shell and act as elastic current bridges between the bus bar or socket element and the contact strip carrying the current located within the connection apparatus.

13 Claims, 4 Drawing Sheets

PLUG ELEMENT FOR AN ELECTRICAL CONNECTION, IN PARTICULAR IN DISTRIBUTION BOARDS OR SIMILAR INSTALLATIONS

CONTINUING APPLICATION DATA

This application is a continuation-in-part application of International Patent Application No. PCT/EP91/00729 filed on Apr. 17, 1991, which designated the U.S., which claims priority under 35 U.S.C. §119 from Federal Republic of Germany Patent Application No. P 40 13 311, filed on Apr. 26, 1990.

BACKGROUND OF THE INVENTION

1. Field of the Invention

This invention relates to a plug element for an electrical connection, in particular for the electrical connection of switchgear with bus bars or socket elements in distribution boards or units, preferably in withdrawable distribution units.

2. Background Information

Contact systems of the prior art have, perpendicular to the plug or fastening plane, flexible contact tabs or contact segments of a known type, which make contact with the bars carrying the current. Such a contact system is disclosed in German Patent No. 26 47 573, in which a spring tab is folded around a leaf-shaped segment, and is equipped with a coil spring, which is in contact with the inside of the tab and presses it outward, whereby the outer sides of the tab, under pressure from the spring, come into contact with the contact surfaces of two rectangular-shaped bus bars running parallel to them. Such contact systems are relatively sensitive to warping or twisting.

The plug-in contact disclosed in EP 0 086 316 represents another contact system.

This plug-in contact consists of two interacting contact wires which are held in a U-profile by a leaf spring. The contact surface is formed by a center contact tab of the first contact wire and two side contact tabs of the second contact wire, one on either side of the center contact tab. The intended purpose of this complex design is to make the system relatively insensitive to warping or twisting.

German Published Patent Appln. No. 32 43 064 discloses an additional contact system. In this system, plug elements are provided with U-shaped springs, which U-shaped springs counteract the expansion of locator slots located on the plug elements.

These plug elements are provided with sleeves to hold the cable ends. However, they are not suitable for making contact with C-shaped bus bars or bus bars with slot-shaped tap zones.

German Patent No. 31 26 306 also discloses contact units which contain a cage-like housing and several pairs of contact laminars. Each contact laminar is subject to the action of a leaf spring. Such contact units have the same disadvantage as the contact system disclosed in German Published Patent Appln. No. 32 43 064.

The prior art also includes plug systems which have contact laminars. Such contact laminars, as described in the BBC publication "Konstrukteur" 5/69, Page 185, have laminar segments which conform relatively well with the contact surfaces, even if the latter do not run completely parallel.

The individual laminar segments of the louver-like slotted contact strip form an intermediate layer between two contact surfaces. These laminar segments flex around their longitudinal axis with a certain torsional force if they are compressed by these contact surfaces, which means that the contact strip acts as an elastic contact layer.

However, the manufacture of a plug connector to hold the contact laminar strips is complex and expensive.

OBJECT OF THE INVENTION

The object of the invention is to create a plug element for electrical connection which plug element has good contact characteristics, consists of simple parts, can be manufactured economically, is easy to assemble and install, and is also suitable for the electrical connection to C-shaped bus bars or to bus bars with slot-shaped tap zones.

SUMMARY OF THE INVENTION

This object is achieved by plug elements of the present invention, which present invention preferably has a plug shell, a contact strip, and contact laminar strips. The laminar strips can be embedded in openings of the plug shell and can act as elastic current bridges. As a result of the invention, in spite of the use of contact laminar strips, the use of a plug-in connector, which is generally complex and expensive to manufacture, is no longer necessary. However, the good contact characteristics of contact laminars are retained, even when there is a slight warping, twisting or rotation of the plug element.

It is particularly advantageous to make the plug shell of thermoplastic or thermosetting plastic, and the contact strip as a punched part, whereby the plug shell and the contact strip are each composed of two identical halves.

The present invention is characterized by a plug element having two symmetrical halves whose inner surfaces preferably have dovetail guide grooves and dovetail guide segments as well as pins in the shell wall. The dovetail guides and the pins in the shell wall provide a positive connection between the two plug shell halves to produce an additional advantageous embodiment of the invention. As a result of these features, there is a strong and secure connection of the two shell halves, and the plug element is particularly easy to assemble and install as a result of the use of screwless connections.

The plug element of the present invention is further characterized by guide segments located in the vicinity of window like openings, against which the contact strip halves are braced. The contact strips halves along the area coming out of the plug shell are preferably provided with stepped cross sections so that any outgoing lines can be crimped against a narrow strip segment. In addition, the contact laminar strips have inwardly tapering lateral fastening edges that are embedded in grooves along the edges of window like openings. The above embodiments disclose particularly advantageous refinements of the invention.

A particular advantage of the embodiment of the present invention is that the half-arrow shaped contour of the groove holding the contact laminar strip, during installation, makes possible a locking of the contact laminar strips from the inside of the plug shell out. Another feature of the present invention is that the plug element is securely guided into the slot in the bar, while being plugged into a C-shaped bus bar, a bus bar with slotted tap zones or a jack element.

Another particular advantage of the present invention resides in the plug element for electrical connections having a mounting element and elastic current transmission elements, as well as a plug shell, contact strip, and contact laminar strips, which laminar strips can be embedded in window like openings of the shell and act as elastic current bridges.

BRIEF DESCRIPTION OF THE DRAWINGS

One preferred embodiment of the invention is schematically illustrated in the accompanying drawings.

DESCRIPTION OF THE PREFERRED EMBODIMENTS

Figure 1:
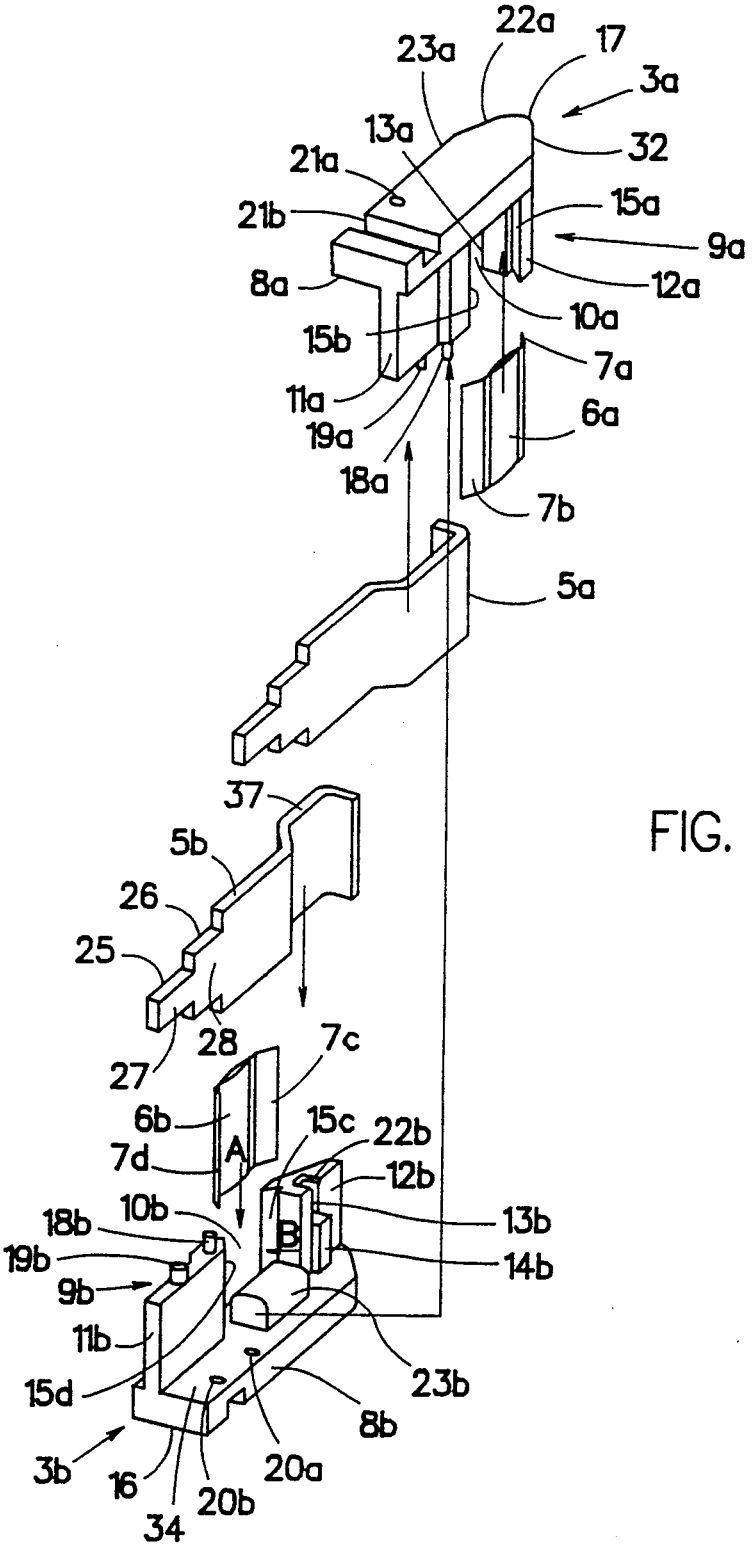
FIG. 1 shows, in perspective view a disassembled plug element for the electrical connection of switchgear to C-shaped bus bars.

The plug element 1 shown in the drawings can be used for the electrical connection of switchgear or similar devices to a C-shaped bus bar, or to a socket element in distribution boards or panels.

Figure 2:
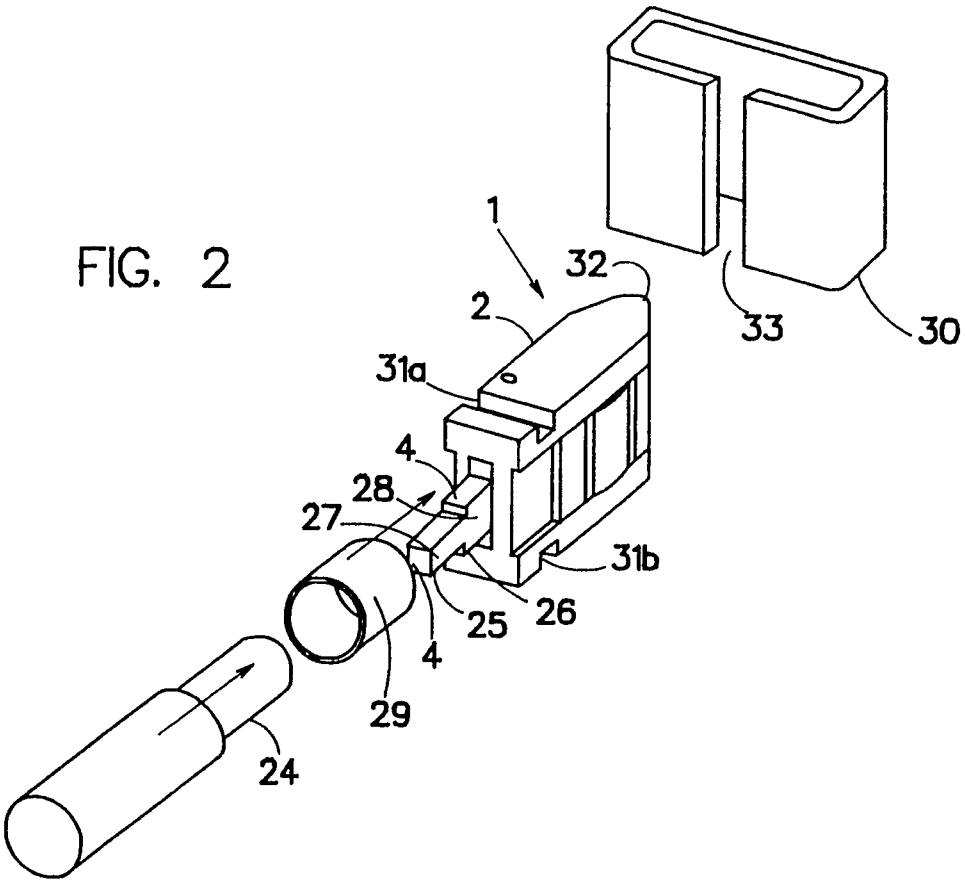
FIG. 2 shows a perspective view of the plug element, assembled.

As shown in FIGS. 1 and 2, the plug element essentially consists of a plug shell 2, which consists of two identical plug shell halves 3*a*, 3*b*, a contact strip 4 with two identical contact strip halves 5*a*, 5*b*, and two symmetrical and parallel contact laminar strips 6*a*, 6*b*, each with two tapered fastening edges 7*a*, 7*b*, 7*c*, 7*d* on the side.

The plug shell halves 3*a*, 3*b* can preferably be made of a thermoplast or a thermosetting plastic, and each can preferably consist of a cover plate 8*a*, 8*b*, and a shell wall 9*a*, 9*b* molded at a right angle. Each shell wall 9*a*, 9*b* is divided into two zones 11*a*, 11*b*, 12*a*, 12*b*, so that when the plug shell 2 is assembled, window-like openings 10*a*, 10*b* are formed.

The plug shell halves could also be made of metal, e.g. employing a die casting process. The plug shell halves are designed so that they can be connected by means of a positive and form fitting connection, without any additional fastening means.

Perpendicular to the cover plate 8*a*, 8*b*, the end zones 12*a*, 12*b* preferably have a dovetail guide groove 13*a*, 13*b*, which makes the transition into a likewise dovetail guide segment 14*b*, which guide segment 14*b* preferably is present in each symmetrical end zone and extends lengthwise to approximately the center of the guide groove 13*a*, 13*b*, and penetrates the identically-shaped guide groove 13*a*, 13*b* of the other half 3*a*, 3*b* of the plug shell by insertion into an introductory taper 22*a*, 22*b*. In this manner a positive and form fitting connection of the two plug shell halves 3*a*, 3*b* into a single plug shell 1, is achieved.

An additional form-fitting connection is achieved, in that in the rear zone 11*a*, 11*b* of the shell wall 9*a*, 9*b*, there are pins 18*a*, 18*b*, 19*a*, 19*b* designed so that they are engaged in holes 20*a*, 20*b*, 21*a*, 21*b* located on the cover plate 8*a*, 8*b* of the other half of the plug shell 3*a*, 3*b*.

The contact laminar strips 6*a*, 6*b* are embedded with their inwardly tapering lateral fastening edges 7*a*, 7*b*, 7*c*, 7*d* in grooves 15*a*, 15*b*, 15*c*, 15*d* of the plug shell 2, adjacent to the edges of the window-like openings 10*a*, 10*b*. In this manner the contact laminar strips 6*a*, 6*b* fill up the entire surface of the window-like openings 10*a*, 10*b*. These grooves 15*a*, 15*b*, 15*c*, 15*d* have a continuous half-arrow shaped contour running perpendicular to the shell wall 9*a*, 9*b*. This half-arrow configuration makes possible an introduction (in the groove direction (Arrow A)) or locking (from the inside of the plug shell 2 out (Arrow B)) of the contact laminar strips 6*a*, 6*b* into the grooves 15*a*, 15*b*, 15*c*, 15*d* before the assembly of the plug shell 2 is performed.

As also shown in FIG. 1, molded onto the cover plate 8*a*, 8*b* of each plug shell half 3*a*, 3*b*, in the vicinity of the window-like openings 10*a*, 10*b*, is a guide segment 23*a*, 23*b* which fixes the contact strip halves 5*a*, 5*b* in the plug shell 2.

The contact strip halves 5*a*, 5*b* can be preferably designed as punched parts, and are shaped so that they are braced against the guide segment 23*a*, 23*b* in the zone facing the end surface 17 of the plug element 1. The strip halves 5*a*, 5*b* are also preferably in contact with the inside of the contact laminar strips 6*a*, 6*b*, which laminar strips 6*a*, 6*b* have a series of twisted louver like segments with slots therebetween on the first portion, and inwardly tapered side portions with serrations that run perpendicular to the louver like slotted front portion. These side portions are preferably used as fastening edges.

The contact strip halves 5*a*, 5*b* are preferably joined closely together toward the rear side 16 of the plug shell 2, as shown in particular in FIG. 2, and can be designed for the electrical and mechanical connection of an outgoing line 24 from the plug shell 2. They are also preferably provided with stepped, reduced cross sections 25, 26, so that crimping technology can be used to connect an outgoing line 24 to the narrow strip segment 27, whereby the center strip segment 28 forms a stop for the ferrule 29.

On the cover plates 8*a*, 8*b* of each plug shell half 3*a*, 3*b*, running at right angles to the bus bar 30, there are preferably rectangular grooves 31*a*, 31*b*, which are used to fasten the plug element 1 in a fixture on the reverse side of a withdrawable distributor panel unit. The plug element 1, on its end surface 17, has an introductory taper 32, so that when the plug element 1 is inserted into the C-shaped bus bar 30, it is securely guided into the bar slot 33. This once again guarantee good electrical contact between the contact laminar strips 6*a*, 6*b* and the bus bar 30.

Figure 3:
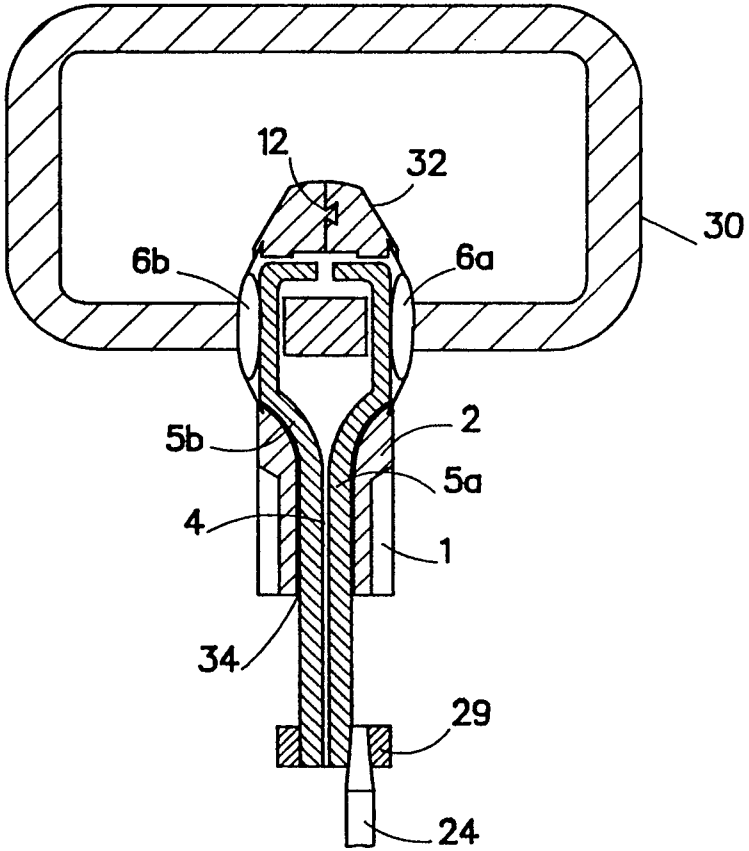
FIG. 3 shows a cross section of the plug element engaged with a C-shaped bus bar.

FIG. 3 shows the plug element 1 in the plugged-in state, and shows how the contact laminar strips 6*a*, 6*b* form an intermediate layer and current bridge between the contact strip halves 5*a*, 5*b* and the C-shaped bus bar 30.

Figure 4:
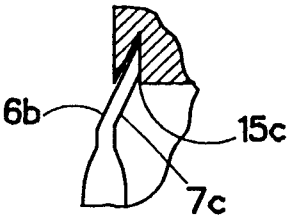
FIG. 4 shows an enlarged detail of the plug element illustrated in FIG. 3, whereby the half-arrow shaped grooves, which grooves hold the contact laminar strip, are clearly visible.

FIG. 4 shows an enlarged detail of how the contact laminar strips 6*a*, 6*b* are embedded in the half-arrow shaped grooves 15*a*, 15*b*, 15*c*, 15*d* from which the strips 6*a*, 6*b* are thereby prevented from falling out.

Figure 5:
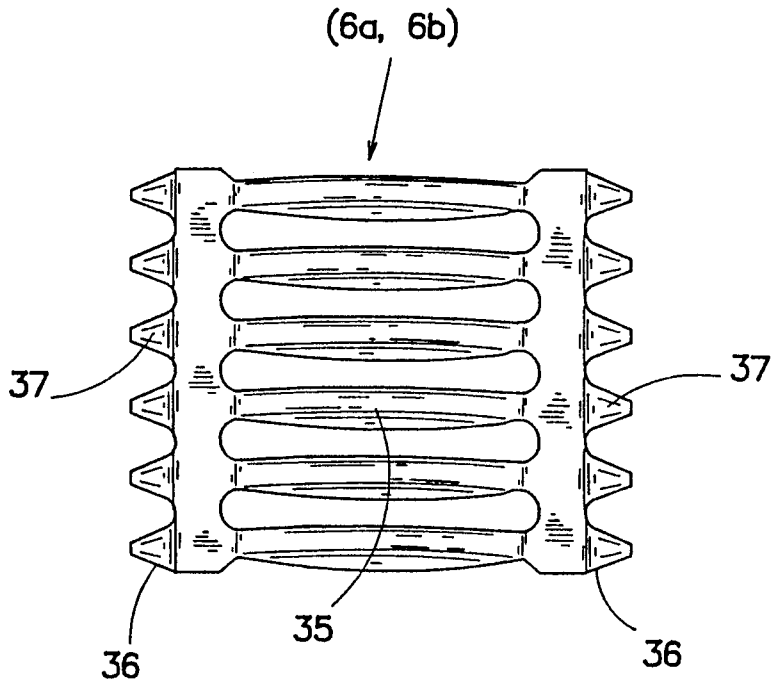
FIG. 5 shows an enlarged detail of the laminar contact strip.

FIG. 5 shows the contact laminar strips 6*a*, 6*b* having a series of twisted, louver like segments 35 with slats therebetween along the front portions 35 and inwardly tapered side portions 36 having serrations 37 running perpendicular to the louver like slotted front.

In summary, one feature of the invention resides broadly in a plug element for an electrical connection, in particular of switchgear with C-shaped bus bars, bus bars with slot-like tap zones, or socket elements in distribution installations, preferably in withdrawable unit distribution boards or panels, consisting of a mounting element and elastic contact elements for current transmission, characterized by the fact that the plug element (1) consists of a plug shell (2), a contact strip (4) and contact laminar strips (6*a*, 6*b*), whereby the contact laminar strips (6*a*, 6*b*) are embedded in window-like openings (10*a*, 10*b*) of the plug shell (2), and are held by the latter, so that they act as elastic current bridges between the bus bar or the socket element and the contact strip (4) carrying the current.

Another feature of the invention resides broadly in a plug element, characterized by the fact that the plug shell (2) is made of insulating material.

Yet another feature of the invention resides broadly in a plug element, characterized by the fact that the plug shell (2) is made of metal.

A further feature of the invention resides broadly in a plug element, characterized by the fact that the plug shell (2) consists of two identical plug shell halves (3*a*, 3*b*) which, when assembled on the flat sides, form window-like openings (10*a*, 10*b*) to hold contact laminar strips, and have a closed plug front wall on their end surface (17), and have an opening (34) on their rear side (16) for the contact strip (4) carrying the outgoing current.

A yet further feature of the invention resides broadly in a plug element, characterized by the fact that the plug shell halves (3*a*, 3*b*) are positively connected and form-fitted together without additional fastening means.

Yet another further feature of the invention resided broadly in a plug element, characterized by the fact that the contact strip (4) consists of two identical, symmetrically oriented contact strip halves (5*a*, 5*b*) designed as punched parts, which are shaped so that on one hand they contact the inside of the contact laminar strips (6*a*, 6*b*), and on the other hand, are combined closely together toward the back side (16) of the plug element (1), and are brought out of the plug shell (2) for the connection of an outgoing line (24).

An additional feature of the invention resides broadly in a plug element, characterized by the fact that the inner surfaces of the plug shell halves (3*a*, 3*b*) in the end region (12), have a dovetail guide groove (13*a*, 13*b*) running perpendicular to the cover plate (8*a*, 8*b*), which groove makes the transition into a likewise dovetail guide segment (14*a*, 14*b*), the length of which extends to approximately the middle of the guide groove (13*a*, 13*b*), so that the two plug shell halves (3*a*, 3*b*) can thereby be positively connected to form a single plug shell (2).

A yet additional feature of the invention resides broadly in a plug element, characterized by the fact that in the rear area (11*a*, 11*b*) of the shell wall (9*a*, 9*b*) of the plug shell half (3*a*, 3*b*), there are pins (18*a*, 18*b*, 19*a*, 19*b*) which are engaged in holes (20*a*, 20*b*, 21*a*, 21*b*) on the other plug shell half (3*a*, 3*b*), and thereby form an additional positive connection between the two plug shell halves.

A further additional feature resides broadly in a plug element, characterized by the fact that on the cover plate (8*a*, 8*b*) of the plug shell halves (3*a*, 3*b*), in the vicinity of the window-like openings (10*a*, 10*b*), there is a guide segment (23*a*, 23*b*), against which the contact strip halves are braced, whereby the contact strip halves (5*a*, 5*b*) are fixed in the plug shell (2).

A yet further additional feature of the invention resides broadly in a plug element, characterized by the fact that the contact laminar strips (6*a*, 6*b*), with their inwardly tapering lateral fastening edges (7*a*, 7*b*, 7*c*, 7*d*), are embedded in grooves (15*a*, 15*b*, 15*c*, 15*d*) on the edges of the window-like openings (10*a*, 10*b*) of the plug shell (2), and that the grooves (15*a*, 15*b*, 15*c*, 15*d*) have a half-arrow shaped contour which runs perpendicular to the shell wall (9*a*, 9*b*).

Another further additional feature of the invention resides broadly in a plug element, characterized by the fact that the contact strip halves (5*a*, 5*b*), in the area coming out of the plug shell (2), are provided with stepped cross section reductions (25, 26), so that an outgoing line (24) can be connected to the narrow strip segment (27) by means of crimping.

A yet another additional feature of the invention resided broadly in a plug element, characterized by the fact that the plug shell (2) has an introductory taper (32) on its end surface (17).

A still further feature of the invention resides broadly in a plug element, characterized by the fact in the rear area of the plug shell (2), there are grooves (31*a*, 31*b*) running at right angles to the bus bar (30), which hold the plug element (1) in a fixture.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Plug element for an electrical connection, in particular of switchgear with C-shaped bus bars, bus bars with slot-like tap zones, or socket elements in distribution installations, preferably in withdrawable unit distribution boards or panels, consisting of a mounting element and elastic contact elements for current transmission, characterized by the fact that the plug element consists of a plug shell, a contact strip and contact lamination strips, whereby the contact lamination strips are embedded in window-like openings of the plug shell, and are held by the latter, so that they act as elastic current bridges between the bus bar or the socket element and the contact strip carrying the current.

2. Plug element according to claim 1, characterized by the fact that the plug shell is made of insulating material.

3. Plug element according to claim 1, characterized by the fact that the plug shell is made of metal.

4. Plug element according to claim 1, characterized by the fact that the plug shell consists of two identical plug shell halves comprising flat sides, wherein the plug halves, when assembled on the flat sides, form window-like openings to hold contact lamination strips, and have a closed plug front wall on their end surface, and have an opening on their rear side for the contact strip carrying the outgoing current.

5. Plug element according claim 4, characterized by the fact that the plug shell halves are positively connected and form-fitted together without fastening means provided separately from the plug shell halves.

6. Plug element according to claim 5, characterized by the fact that the contact strip consists of two identical, symmetrically oriented contact strip halves designed as punched parts, which are shaped so that on one hand they contact the inside of the contact lamination strips, and on the other hand, are combined closely together toward the back side of the plug element, and are brought out of the plug shell for the connection of an outgoing line.

7. Plug element according to claim 6, characterized by the fact that the inner surfaces of the plug shell halves in the end region, have a dovetail guide groove running perpendicular to the cover plate, which groove makes the transition into a likewise dovetail guide segment, the length of which extends to approximately the middle of the guide groove, so that the two plug shell halves can thereby be positively connected to form a single plug shell.

8. Plug element according to claim 7, characterized by the fact that in the rear area of the shell wall of the plug shell half, there are pins which are engaged in holes on the other plug shell half, and thereby form an additional positive connection between the two plug shell halves.

9. Plug element according to claim 8, wherein the plug shell halves comprise a cover plate, characterized by the fact that on the cover plate of the plug shell halves, in the vicinity of the window-like openings, there is a guide segment, against which the contact strip halves are braced, whereby the contact strip halves are fixed in the plug shell.

10. Plug element according to claim 9, wherein the contact lamination strips comprise inwardly tapering lateral fastening edges, characterized by the fact that the contact lamination strips, with their inwardly tapering lateral fastening edges, are embedded in grooves on the edges of the window-like openings of the plug shell, and that the grooves have a half-arrow shaped contour which runs perpendicular to the shell wall.

11. Plug element according to claim 10, characterized by the fact that the contact strip halves, in the area coming out of the plug shell, are provided with stepped cross section reductions, so that an outgoing line can be connected to the narrow strip segment by means of crimping.

12. Plug element according to claim 11, characterized by the fact that the plug shell has an introductory taper on its end surface.

13. Plug element according to claim 12, characterized by the fact in the rear area of the plug shell, there are grooves running at right angles to the bus bar, which hold the plug element in a fixture.

* * * * *